United States Patent [19]

Balke

[11] 4,015,331

[45] Apr. 5, 1977

[54] DOMESTIC OR TRADESMAN'S KNIFE

[76] Inventor: Karl Heinz Balke, No. 4a, Schubertstrasse, Solingen 19, Germany

[22] Filed: Feb. 9, 1976

[21] Appl. No.: 656,455

[30] Foreign Application Priority Data

Feb. 15, 1975 Germany ..... 2506406

[52] U.S. Cl. ..... 30/355; 83/851

[51] Int. Cl.[2] ..... B26B 9/02

[58] Field of Search ..... 30/353, 355; 83/848, 83/849, 850, 851

[56] References Cited

UNITED STATES PATENTS

| | | | |
|---|---|---|---|
| 2,799,930 | 7/1957 | Champlin | 30/355 |
| 3,205,575 | 9/1965 | Senkewitz | 30/355 |
| 3,488,845 | 1/1970 | Tausendfreundt | 30/355 |

FOREIGN PATENTS OR APPLICATIONS

| | | | |
|---|---|---|---|
| 11,357 | 2/1933 | Australia | 83/851 |

*Primary Examiner*—Al Lawrence Smith
*Assistant Examiner*—J. C. Peters
*Attorney, Agent, or Firm*—Lowe, King, Price & Markva

[57] ABSTRACT

A domestic or tradesman's knife is provided with cutting teeth ground off alternately on opposite sides to form a cutting edge on each side of the blade in the manner of the teeth of a saw, the invention consisting in the provision of cutting teeth intermediately between the two rows of cutting teeth on the sides of the blade.

4 Claims, 6 Drawing Figures

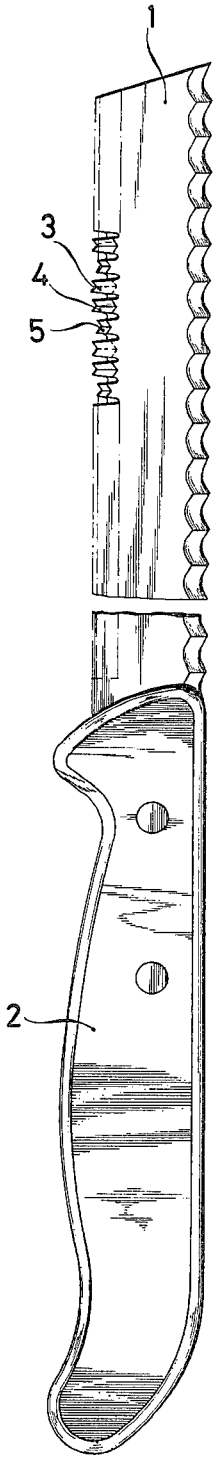
FIG.1
FIG. 2
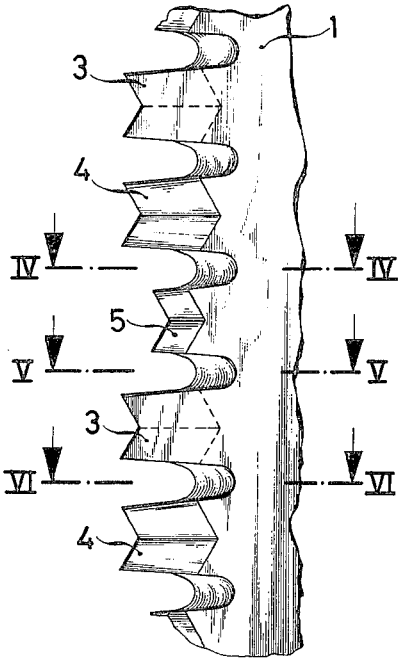
FIG. 3
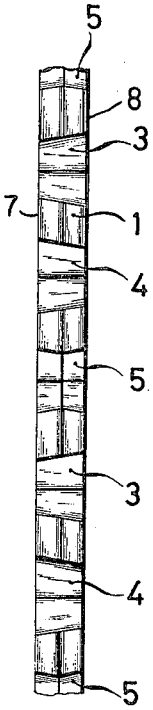
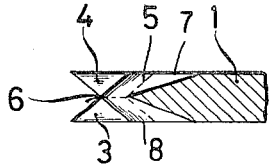
FIG.4
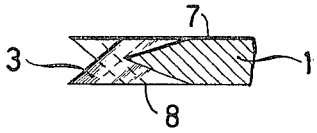
FIG. 5
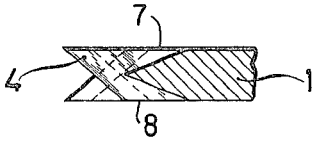
FIG. 6

DOMESTIC OR TRADESMAN'S KNIFE

BACKGROUND OF THE INVENTION

This invention relates to a domestic or tradesman's knife provided with cutting teeth which are ground off alternately on opposite sides to define a cutting edge on each side of the blade for cutting a kerf like the teeth of a saw.

Such knives are known in the art. They have the same cutting properties as the set teeth of a saw and they therefore have a much better bite than an ordinary blade. Consequently they are particularly suitable for cutting deep-frozen goods. Nevertheless, conventional knives of this kind have one major drawback, namely that material remaining between the two rows of teeth must be reduced by attrition between the flanks of the teeth. This greatly increases the friction between the blade and the cut material and more effort is needed for making the cut. Furthermore, the gullets between the teeth tend to become choked when such knives are in use, so that the blade must be cleaned at short intervals.

SUMMARY OF THE INVENTION

It is the object of the invention to improve the cutting edge of a knife of the contemplated kind in such a way that less effort is needed for cutting.

To attain this object the present invention provides a domestic or tradesman's knife having a handle and a blade provided with two rows of cutting teeth ground off alternately on opposite sides to form a cutting edge on each side of the blade in the manner of saw teeth having points, intermediate cutting teeth being provided between the two rows of cutting teeth on the sides of the blade.

Preferably the points of the intermediate cutting teeth may be lower than the points of the cutting teeth on the sides.

The great advantage afforded by the invention resides in that material which remains in the kerf when the outer cutting teeth first start to cut is at once removed by the intermediate cutting teeth in the middle. Consequently the penetration of the cutting teeth forming the outer rows will not be impeded as hitherto by material that has not been cut off in the middle of the kerf. Hence cutting becomes very much easier. Moreover, the gullets are prevented from being choked as was the case hitherto.

It is further proposed that when viewed from the side the intermediate cutting teeth have an M-shaped contour.

Giving the intermediate cutting teeth this particular shapes ensures that material remaining between the two rows of outer teeth will be removed by either the one or the other sloping cutting edge of the intermediate cutting teeth, depending upon the direction of cut.

According to another feature of the invention it is preferred that, when viewed in cutting direction, the intermediate cutting teeth have an inverted Vee-shaped contour.

The point of the inverted Vee more easily cuts and removes material that remains between the two outer rows of cutting teeth when cutting begins.

BRIEF DESCRIPTION OF THE DRAWING

An embodiment of the invention will now be described by way of example and with reference to the accompanying drawing, in which:

FIG. 1 is a side view of a knife according to the invention;

FIG. 2 is a side view, on an enlarged scale, of part of the blade of the knife shown in FIG. 1;

FIG. 3 is an edge-on view of the cutting edge of the knife;

FIG. 4 is a section taken on the line IV—IV of FIG. 2;

FIG. 5 is a section taken on the line V—V of FIG. 2, and

FIG. 6 is a section taken on the line VI - VI of FIG. 2.

DESCRIPTION OF THE PREFERRED EMBODIMENTS

The illustrated knife consists of a blade 1 and a handle 2. The blade 1 has two rows of cutting teeth 3 and 4 which have been produced by grinding off the edge alternately from opposite sides, so that the teeth form a cutting edge on each side of the blade 1 and are relatively offset to cut a kerf like the teeth of a saw.

According to the proposal of the invention intermediate cutting teeth 5 are additionally provided between the two rows of cutting teeth 3 and 4. When viewed from the side these additional teeth in the illustrated embodiment have an M-shaped contour and, when viewed in cutting direction, they have either a straight or, as shown, an inverted Veeshaped contour forming a point at 6.

Described in a further way, as is evident from the drawings, the knife blade 1 includes a plurality of teeth 3, 4 and 5 located in an ordered disposition along at least one edge thereof. The ordered disposition of teeth includes a set of two rows of cutting teeth 3 and 4 and a third row of intermediate cutting teeth 5 being located between each set of two rows as shown. Blade 1 has two smooth opposing faces 7 and 8. Each row of a set of two rows of teeth 3 and 4 are ground off alternately on opposite sides of the blade 1. Thus, a cutting edge is formed within the plane of each of the smooth faces 7 and 8 of the blade 1. The third row of intermediate cutting teeth 5 is ground off from both faces 7 and 8. Thus, the point 6 is formed on each third row at a location intermediate the two faces 7 and 8 of the blade 1.

While the domestic or tradesman's knife has been shown and described in detail, it is obvious that this invention is not to be considered as being limited to the exact form disclosed, and that changes in detail and construction may be made therein within the scope of the invention, without departing from the spirit thereof.

What is claimed is:

1. A knife for cutting food, said knife consisting essentially of:

a. a handle and a blade, b. said blade including a plurality of teeth located in an ordered disposition along at least one edge thereof;

c. said ordered disposition of teeth including a set of two rows of cutting teeth and a third row of intermediate cutting teeth being located between each set of two rows of cutting teeth;

d. said blade having two smooth opposing faces with each row of said set of two rows of cutting teeth being ground off alternately on opposite sides of the blade to form a cutting edge within the plane of each of the smooth faces of the blade;

e. said third row of intermediate cutting teeth being ground off from both faces to form a point on each third row at a location intermediate said two faces of the blade.

2. A knife as defined in claim 1 wherein the points of the intermediate cutting teeth are lower than the points of the cutting teeth forming the cutting edges along the opposing faces of the blade.

3. The knife as defined in claim 1 wherein the intermediate cutting teeth have an M-shaped contour when viewed from the side of the blade.

4. A knife as defined in claim 1 wherein the intermediate cutting teeth have an inverted Vee-shaped contour when viewed in the cutting direction of the blade.

* * * * *